United States Patent [19]

Hauk

[11] 4,220,201

[45] Sep. 2, 1980

[54] CASING PERFORATOR

[75] Inventor: Ernest D. Hauk, Yucca Valley, Calif.

[73] Assignee: Service Equipment Design Co., Inc., Signal Hill, Calif.

[21] Appl. No.: 13,270

[22] Filed: Feb. 21, 1979

[51] Int. Cl.[2] ..... E21B 43/112

[52] U.S. Cl. ..... 166/55.2; 83/191; 30/103

[58] Field of Search ..... 166/55.2, 55.3, 55.6, 166/55.7, 55.8; 30/103, 108; 175/269, 285; 83/191, 178

[56] References Cited

U.S. PATENT DOCUMENTS

| | | | |
|---|---|---|---|
| 1,030,992 | 7/1912 | Fulmer . | |
| 1,125,513 | 1/1915 | Graham . | |
| 2,753,935 | 7/1956 | Fredd | 166/55.2 |
| 3,156,285 | 11/1964 | Layne . | |
| 3,331,439 | 7/1967 | Sanford | 166/55.8 |
| 4,106,561 | 8/1978 | Jerome | 166/55.2 |

*Primary Examiner*—Stephen J. Novosad

*Attorney, Agent, or Firm*—Gausewitz, Carr, Rothenberg & Edwards

[57] ABSTRACT

A lower portion of water well casing in the ground is perforated by means of a toothed wheel journalled on the end of an arm pivotally carried by an elongated perforator body. The perforator body carries an air driven piston and actuator link connected to pivot the arm and wheel downwardly from an upward retracted position to a lower start position in which a point of one tooth and a flat end of an adjacent tooth contact the interior of the casing. In this start position the axis of rotation of the wheel is in an over-center position, below a line between the arm pivot axis and the point of the upper one of the two teeth that contact the casing surface. In this over-center start position, the perforator body is pulled upwardly so that the wheel teeth are pressed outwardly against the casing surface with great force by the over-center arrangement which urges the wheel axis closer to the casing. Each tooth has a truncated cutting end that extends along a line intersecting an outermost point of the adjacent tooth to provide optimum penetration of the casing wall.

24 Claims, 6 Drawing Figures

CASING PERFORATOR

BACKGROUND OF THE INVENTION

The present invention relates to the perforation of casing, and more particularly concerns an improved apparatus for providing a series of perforations in a well casing that has been driven into the ground.

In many types of well drilling operations it is necessary or desirable to puncture the casing at points below the ground. In the drilling of water wells, for example, it is common practice to drive the well casing to a desired depth at or beyond water bearing strata and then to perforate the casing at points within the upper and lower boundaries of the water bearing strata to facilitate flow of water into the well casing. A variety of devices has been suggested in the past for such casing perforating operation. Many of such devices include pivoted levers and wedges. Many include toothed cutting wheels that are driven into cutting engagement with the casing by various mechanisms. Several, such as the U.S. Pat. No. to Jerome 4,106,561, employ a cutter wheel journalled on an arm that is pivoted by means of an air cylinder to cause the teeth to engage the pipe wall. While the teeth are thus held against the wall, the entire perforator is moved downwardly in a manner that is said to further press the teeth against the wall to achieve penetration and rotation of the wheel along the surface of the pipe as the perforator moves downward.

Devices of the prior art have proved difficult to use, costly to manufacture, inefficient in operation, and fail to provide satisfactory service in the field. In many such devices, such as in the perforator of the Jerome patent, for example, the initial motion of the wheel into engagement with the casing interior is achieved by a relatively smaller force, a force exerted by an air cylinder. This force is generally not large enough to effect penetration of the casing by the wheel teeth, but is employed to position the teeth in a cutting position. For the actual penetration and cutting action, the entire perforator, including its pivoted arm and its actuating air cylinder, is moved downwardly by driving the drill string to which the perforator is attached. However, it is found that in many cases this greater downward force applied by moving the drill string is not exerted in the proper direction to achieve the desired penetration since the positioning force of the air cylinder is not great enough to achieve penetration. The result is that as the entire perforator is driven by the drill spring, the cutter wheel teeth merely roll or slide along the interior of the casing with the teeth pressing against but not penetrating the casing.

A major problem with devices of this type is the inability to reliably accomplish initial penetration since, when the tooth of the cutter wheel has actually penetrated the casing wall, no further sliding of the wheel along the interior surface of the casing will occur. In many cases, it is not desirable or feasible to provide a large enough air cylinder and sufficient air pressure to accomplish the initial penetration. However, the prior art includes no satisfactory apparatus that successfully employs the much greater force that is readily applied via the drill string itself to effect the initial penetration.

Accordingly, it is an object of the present invention to achieve perforation of a casing in a manner that minimizes or avoids above mentioned problems.

SUMMARY OF THE INVENTION

In carrying out principles of the present invention, in accordance with a preferred embodiment, an elongated perforator body carries a pivot arm to which is journalled a toothed cutter wheel. The arm and wheel are movable about the axis of the pivot arm to a start position wherein the wheel axis is in an over-center relation to a line from the arm pivot axis to the point of contact between the pipe casing and a cutter wheel tooth. When the perforator body is moved to effect the cutting action, the wheel axis is restrained from moving closer to its dead-center position, and thus an increasingly greater outward force is exerted upon the wheel to effect penetration of the casing.

According to a feature of the invention, the desired over-center start position is accomplished with a wheel that has at least one truncated tooth, such truncated tooth and an adjacent tooth concomitantly contacting the casing interior when the wheel axis is in over-center position with respect to a dead-center line from the pivot arm axis to the point of contact of the adjacent tooth with the casing.

DETAILED DESCRIPTION

Figure 1:
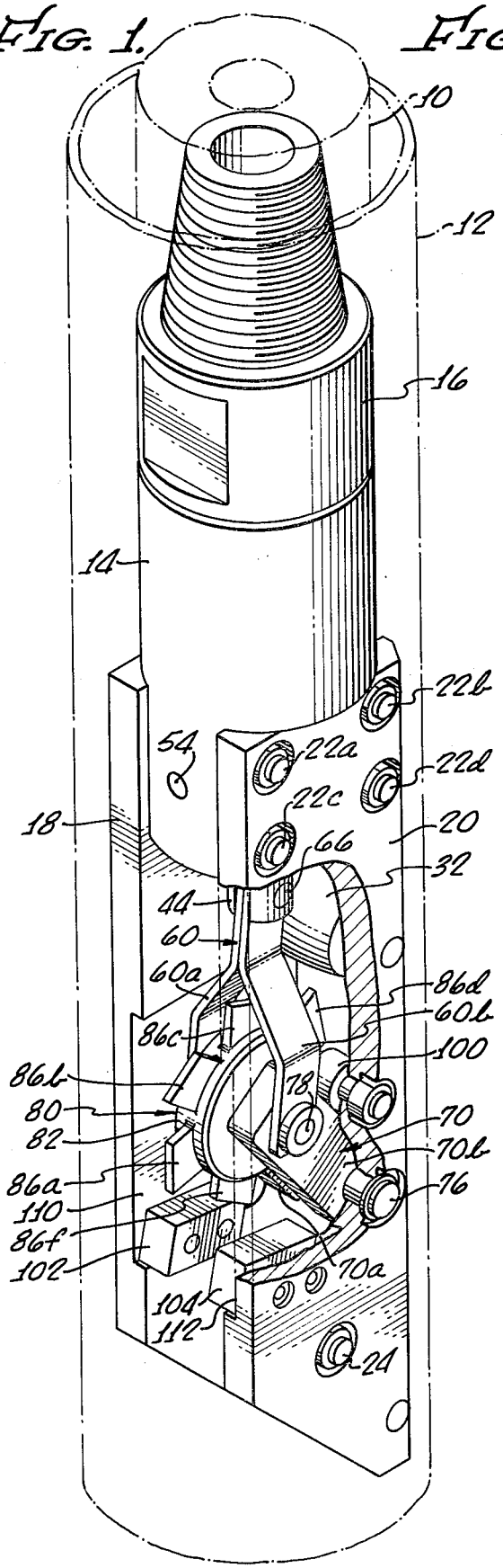
FIG. 1 is a perspective view, with parts cut away, of a casing perforator embodying principles of the present invention.
Figure 2:
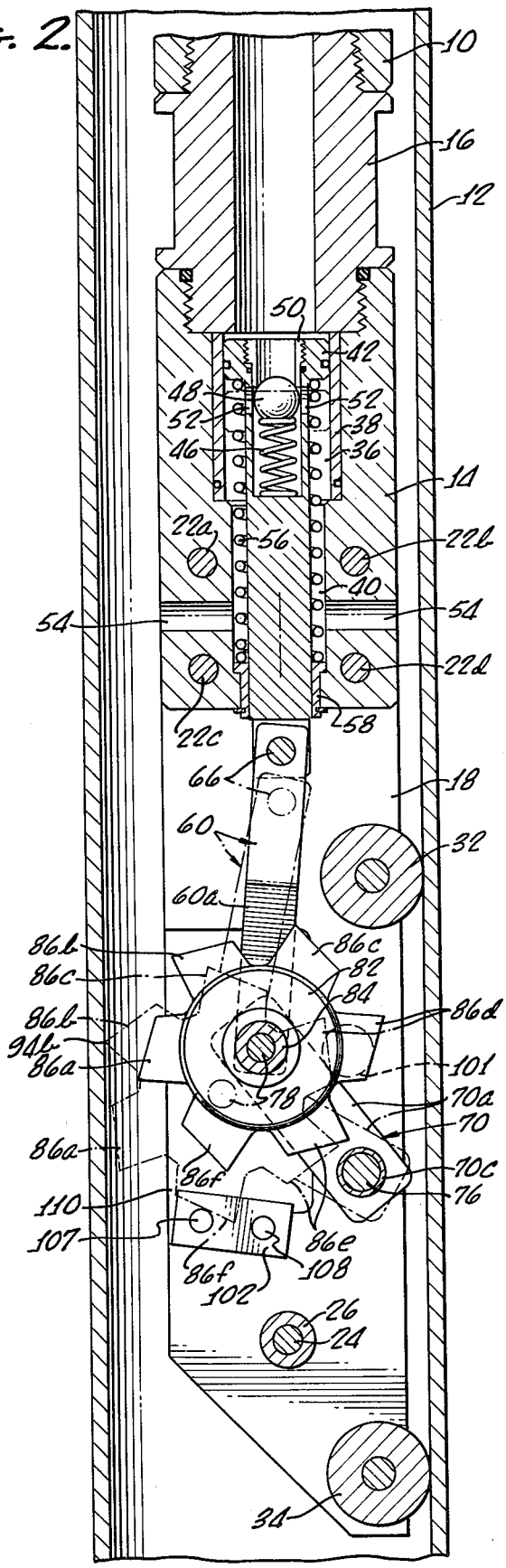
FIG. 2 is a longitudinal sectional view of the casing perforator of FIG. 1 positioned within a well casing to be perforated.
Figure 5:
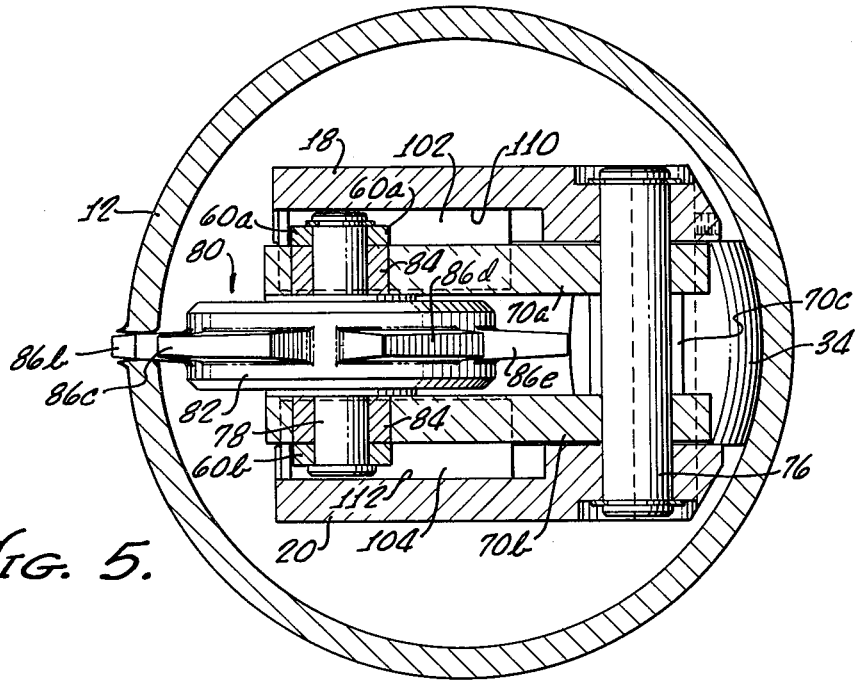
FIG. 5 is a horizontal cross section of the perforator taken on lines 5—5 of FIG. 4.

Referring to FIGS. 1, 2 and 5, the perforator is fixed to the lower end of a string of drill pipe 10 and lowered into a casing 12 that has been driven into the ground. The perforator is positioned within the casing at a selected elevation such as an elevation at which it is determined that water bearing strata exist. The perforator includes a main generally cylindrical body portion 14 having an upper end internally threaded for reception of an adapter connector 16 which itself has an upper end externally threaded for connection to the lower internally threaded end of the spring of drill pipe 10.

Fixed to and depending from the lower end of main body portion 14, at opposite sides thereof, is a pair of mutually spaced, elongated body side plates 18, 20 which are bolted to the main body portion by a plurality of bolts 22*a*, 22*b*, 22*c*, 22*d*, and fixedly connected to each other in mutually spaced relation by means of a plurality of bolts 24 and spacers 26, the latter extending between and into engagement with facing inner sides of the body side plates. The side plates carry a pair of longitudinally spaced rollers 32, 34 journalled in the side plates about transverse or horizontal axes at one side of the perforator body, and adapted to bear against the interior surface of the casing 12, as illustrated in FIG. 2.

Main body section 14 is longitudinally bored to provide an air cylinder chamber 36 lined by a sleeve 38 and communicating with a lower bore 40. Slidably mounted within the chamber 36 is a piston 42 fixed to the upper end of a downwardly extending piston rod 44 that extends through the bore 40 and then downwardly and outwardly of the main body section between the body side plates. The upper portion of piston rod 44 is hollow and positions a spring 46 carrying at its upper end a check valve ball 48 that is urged upwardly by the spring to seal against the seat of an insert 50 threaded into the upper end of the piston 42. Adaptor 16 is bored to provide an air passage from the interior of the hollow drill pipe to the fitting 50 for passage of air under pressure.

The upper portion of the piston rod 44, just below piston 42, has a pair of oppositely disposed air outlet ports 52 which, when the piston is driven downwardly from the position shown in FIG. 2, are adapted to communicate with a pair of oppositely disposed ports 54 formed in the main body section 14. Ports 54 are open to the exterior of the perforator body and thus to the interior of the casing.

A spring 56 is seated on a bushing 58 fixed in the bottom of rod bore 40. The spring extends upwardly around the piston rod 44 into engagement with the lower surface of piston 42. This spring has a significantly lesser resistance than the check valve spring 46 so that a relatively lower air pressure will drive the piston downwardly without opening the check valve and a relatively higher air pressure will drive the piston downwardly and also open the check valve.

An actuator arm 60, having a pair of downwardly extending and mutually spaced legs 60*a*, 60*b* is pivoted to the lower end of the piston rod 44, where it projects downwardly from the main body section 14, about the axis of a transverse horizontal pin 66.

A pivot arm 70, formed by a pair of pivot arm plates 70*a* and 70*b* that are fixedly connected to each other at the lower ends thereof by a spacer 70*c*, is pivoted to and between the body side plates at a point adjacent the perforator body side at which the rollers are attached. The pivot arm is mounted upon a pivot pin 76 that extends horizontally and transversely of the perforator body through both body side plates, through the arm plates 70*a* and 70*b*, and through the pivot arm spacer 70*c*.

A horizontally and transversely extending spindle pin 78 is journalled in the lower ends of the actuator legs 60*a*, 60*b* and also extends through the upper ends of pivot arm plates 70*a* and 70*b*.

Journalled on the spindle pin 78 between the plates of pivot arm 70 is a cutter wheel 80 having a relatively thick hub 82 apertured to receive a spindle bushing 84 that is sleeved on the spindle pin 78. The hub carries a plurality of circumferentially spaced, generally radially extending cutter teeth 86*a*, 86*b*, 86*c*, 86*d*, 86*e*, 86*f*. Each tooth has its outer end truncated, as indicated in 88, so that the outer end is relatively broad and flat and extends along a line that makes a small angle $\alpha$ relative to a perpendicular 90 to a radius 92 of the wheel that bisects the tooth (see FIG. 3). In effect, the outer end of each tooth is nearly, but not quite, perpendicular to the radius bisecting the tooth, and thus provides an outermost point or tooth toe 94 and an innermost point or tooth heel 96. Thus the line between the heel and toe of the tooth, between points 94 and 96, lies at the small angle $\alpha$ to a tangent to the wheel periphery at the center of the tooth. In a preferred embodiment, the angle $\alpha$ is chosen so that the line of the tooth outer end, the line between the toe and heel of the tooth, will intersect the toe 94 of an adjacent tooth.

Mounted in each of the body side plates 18, 20 are stops 100, 101. Each stop extends inwardly from its respective side plate to a point at or just short of the inner side of each of the pivot arm plates 70*a* and 70*b* so that the stops will not interfere with the cutter wheel but will limit motion of the pivot arm to the retracted position which is illustrated in solid lines in FIG. 2.

Figure 4:
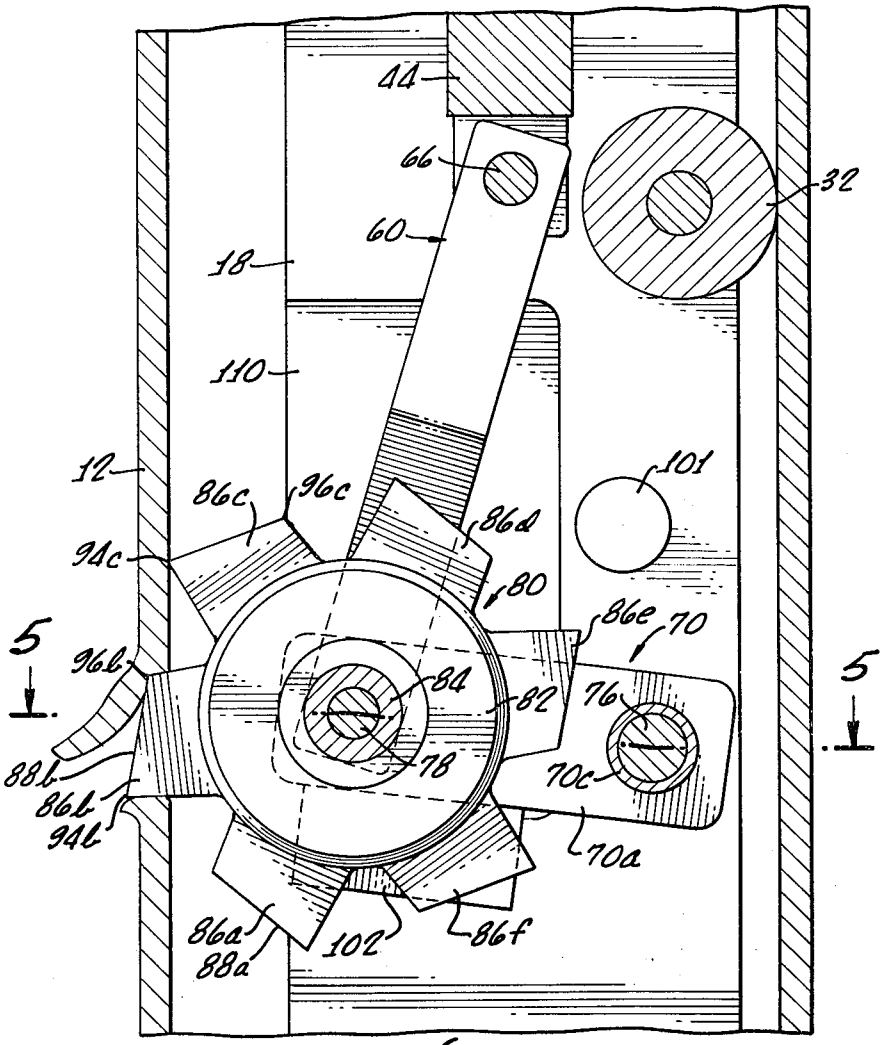
FIG. 4 is a view similar to FIG. 3 illustrating the wheel and arm position near the completion of the first perforation and about to begin a second perforation.
Figure 3:
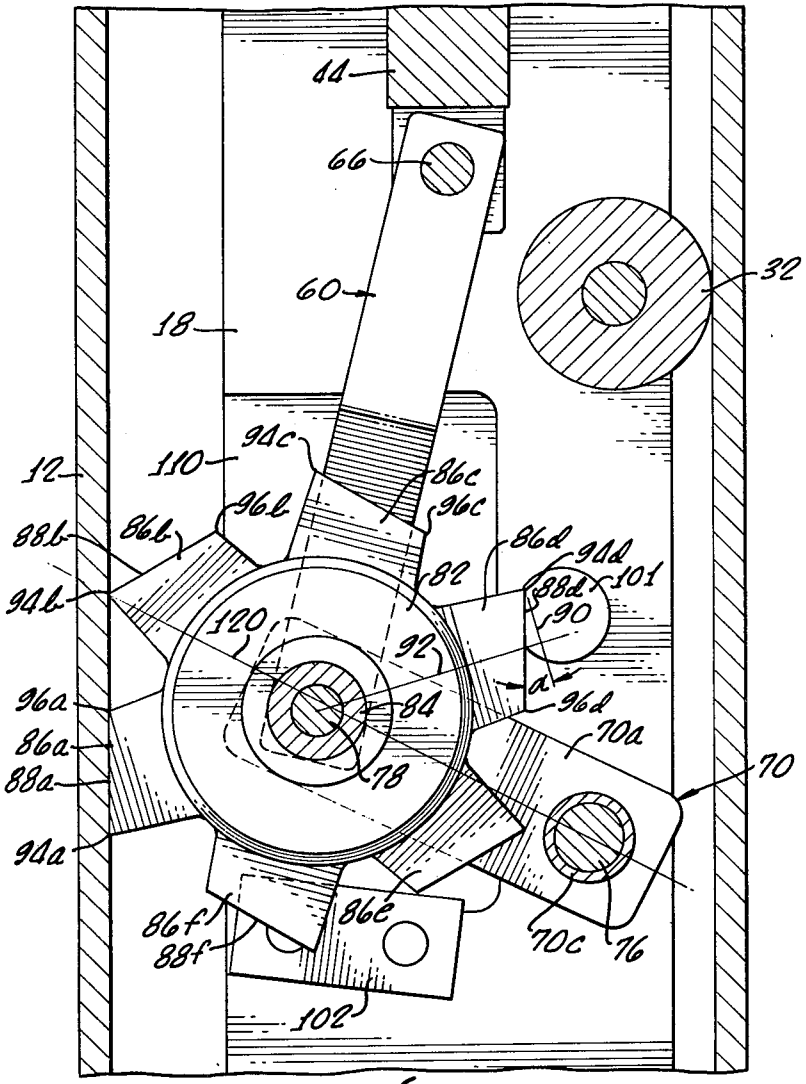
FIG. 3 is a schematic view of the cutter wheel and pivot arm in start position.

Stop blocks 102, 104 are respectively fixed to the body side plates 18, 20, as by bolts 107, 108, for example, and serve to limit pivotal motion of the pivot arm 70 in a counter-clockwise direction as viewed in FIGS. 2, 3 and 4. Side plates 18, 20 are recessed, as indicated at 110, 112 to provide shoulders in abutment with the stop blocks and to permit swinging of pivot arm 70, actuator arm 60, and spindle pin 78.

In operation of the perforator described above, the adaptor is secured to and between the perforator body and the end of a string of drill pipe. The perforator is lowered into the well casing to the desired elevation. No air pressure is applied to the hollow drill pipe and the bore of the adaptor 16. Spring 56 drives the piston to the position illustrated in FIG. 2 whereby the cutter wheel and pivot arm assume the upper, retracted position shown in FIG. 2 is solid lines. In this position, the wheel and pivot arm, which are movable in upward and downward directions as they pivot about the pivot axis of pin 76, are in retracted position with all of the cutter wheel teeth spaced inwardly of the casing wall. The wheel axis is spaced from the inside of the casing by a distance greater than the wheel radius, and the arm is upwardly inclined at a large angle with respect to a perpendicular to the axes of the casing and perforator.

To perform a perforating operation, air under pressure is applied via the hollow drill pipe to the upper end of the piston, but at a pressure that is not sufficient to open the check valve and depress the check valve ball 48. An air pressure of about 80 lbs. per square inch is adequate to actuate the piston in an embodiment of the invention that has been initially constructed. It will be noted that until the wheel teeth contact the casing, the wheel is freely rotatable about the wheel axis. As the pivot arm is moved downwardly, toward a more nearly horizontal position, the wheel, which is in some unknown position of rotation about the wheel axis, may initially contact the casing wall at the toe of one or another of its teeth. One such position of possible initial contact is illustrated in phantom lines in FIG. 2. In the exemplary position shown in phantom in FIG. 2, tooth 86*b* initially contacts the casing at the tooth toe 94*b*. The next adjacent tooth 86*a*, which is the next lower tooth in this particular position, has not part yet in contact with the casing. This is but one of many substantially similar and equivalent positions in which the wheel may initially contact the casing during the downward actuating stroke of the piston 42.

In the illustrated position of initial contact, continued application of air pressure and further downward motion of the piston 42 will cause the wheel to rotate in a clockwise direction as viewed in FIG. 2 to assume the position illustrated in FIG. 3. This position is the start position. In moving from the phantom line position of FIG. 2 to the start position of FIG. 3, the wheel axis, the center of spindle pin 78, has moved to an over-center position with respect to a dead-center line 120 that extends between the pivot arm axis and the point of contact between the tooth toe 94 and the casing. The wheel axis moves downwardly across such a dead-center line so that, in the start position of FIG. 3, it is slightly offset in a downward direction on the other side of the dead-center line 120. Moreover, the wheel axis, in start position, is spaced from the casing by a distance less than the radius of the wheel. In this position the pivot arm 70 is closer to horizontal, being nearly perpendicular to the axes of the casing and perforator body, but is upwardly inclined at a relatively small angle to such perpendicular.

In the start position, the next adjacent tooth, tooth 86*a*, contacts the casing with its truncated outer end lying flat along the casing. This contact of the casing by tooth 86*a* limits the downward pivoting of arm 70 to the illustrated start position, when driven only by the air pressure. It will be observed that if the heel 96*a* of tooth 86*a* were not radially shorter than the toe 94*a*, the wheel and arm could not attain the over-center start position. Having reached the start position of FIG. 3, with the wheel axis below the dead-center line and adjacent the perforator body side opposite the rollers, the entire perforator is then pulled upwardly by raising the string of drill pipe. The recapitulate the operation to this point, the wheel and arm are first moved in a downward direction into the start position, by operation of the air driven actuator, and then the entire perforator is pulled upwardly to perform its cutting.

As the entire perforator is pulled upwardly from the start position, the relatively large upward pulling force is applied to the pivot arm at its pivot axis. The pivot arm is not yet in contact with stop blocks 102, 104. Such upward motion tends to rotate the wheel in a counter-clockwise direction about the wheel axis. It also tends to rotate the pivot arm 70 counter-clockwise about its pivot axis. From another point of view, the initial upward motion of the perforator body tends to rotate the toggle assembly of the wheel and pivot arm about the point of contact of tooth toe 94*b* and the casing.

No counter-clockwise rotation of the wheel is possible without perforation of the casing by tooth 86*b* since such rotation would tend to move the wheel axis closer to its dead-center position. Therefore, the initial upward motion of the perforator from the start position in FIG. 3 exerts a magnified outwardly directed force that causes the tooth toe 94*b* to begin penetration of the casing wall, and thus, the wheel is prevented from sliding along the casing. The outwardly directed force that is applied by the wheel teeth to the casing reacts against the opposite side of the casing by means of the rollers 32, 34. As the pivot arm axis moves upwardly, the wheel axis must move slightly closer to the casing wall that is to be perforated, to the left as illustrated in FIG. 3, because toe 94*b* does not slide along the casing, and this too urges the wheel outwardly with increased force against the casing wall. The illustrated geometry causes the large upward force applied via the drill string to press the wheel outwardly with an even greater force. Upward motion of the wheel axis is resisted primarily by the over-center position of the wheel axis. Rotation of the wheel in a clockwise direction, as viewed in FIG. 3, during this initial motion from the position of FIG. 3, is resisted by the abutment of the lower tooth 86*a* with the casing wall. Thus, during this initial pulling up of the pivot arm, the wheel axis must move downwardly relative to the pivot axis, and the pivot arm therefore pivots further downwardly (in a counter-clockwise direction as viewed in FIG. 3) until it abuts the stop blocks 102, 104.

As the pivot arm pivots downwardly into abutment with the stop blocks 102, 104, as shown in FIG. 4, the upper one of the two casing contacting teeth, tooth 86*b*, produces the first wall perforation and the device reaches full cutting position.

When the arm first contacts the stop blocks 102, 104, the initial cutting tooth 86*b* (which is the initial cutting tooth only for the purposes of this exposition) has partially penetrated the casing wall, and the first perforation has been started, but may not have been completed.

When the apparatus is in the position of FIG. 4, the first perforation has been completed. Further upward movement, produced by continued raising of the drill string and the entire perforator, causes linear upward motion of the pivot arm, without any further pivoting since further pivoting is restained by abutment with the stop blocks. The cutter wheel rotates about the wheel axis in a counter-clockwise direction, creating additional perforations by successive ones of the teeth 86*c*, 86*d*, etc. Once upward movement of the perforator has begun, continued application of air pressure to piston 42 is no longer necessary, but may be continued.

The entire tool is raised for a desired distance, such as six to twelve feet for example, to provide a line of perforations of this length. Then the air pressure is released and the drill string and entire perforator body are pushed down a short distance to release the cutting teeth from the casing perforations whereby the spring 56 will return the pivot arm to retracted position, against stops 100, 101. The tool is then rotated and one or more additional lines of perforations are made as required, the tool being lowered to initial elevation so that all of the lines of perforations will be of the same elevation.

In an initially constructed embodiment, the angle $\alpha$ is approximately 16 degrees for a wheel with six identical teeth, and the wheel axis in the start position of FIG. 3 is over dead-center by a relatively short distance, in the order of $\frac{1}{8}$ of an inch to 3/16 of an inch. For $6\frac{5}{8}$ inch diameter casing, having a wall thickness of 0.280 inches, the value of 16 degrees for the angle $\alpha$ is preferred to provide maximum penetration of the tooth into and through the casing. If this angle is significantly smaller in such an arrangement, the wheel axis will not be able to reach the over-center start position of FIG. 3. If the wheel is not over-center in the start position, raising of the drill string and the entire perforator is more likely to result in either sliding of the wheel teeth along the casing, or in a simple rotation of the wheel with the teeth successively contacting, but not penetrating, the casing. It is the over-center position of the wheel axis in start position that ensures the initial penetration and thus the proper operation of the tool.

If the angle $\alpha$ is significantly greater than 16 degrees, cutting action will take place and the tool will be able the attain the start position of FIG. 3, but the heel 96 of each tooth will then be considerably closer to the wheel axis and provide considerably less penetration of the heel into the casing wall. With such lesser penetration, the perforations actually accomplished may be unsatisfactory.

In the arrangement illustrated in FIGS. 1 through 5, six equally spaced and mutually identical cutter teeth are provided, and this configuration is presently preferred. It will be readily appreciated that other numbers of teeth may be employed. However, if the teeth are too few in number, it may be difficult or impossible to engage two teeth with the casing surface at one time, and for this reason, a minimum of five teeth is preferred. A larger number of teeth will give smaller spacing between adjacent perforations. However, a larger number of teeth requires that each tooth be smaller and thus each tooth has less strength.

In the described arrangement, the cutter wheel will start to cut at a point precisely at or close to the point of first contact between a tooth and the casing. Therefore, the position of the first perforation relative to the initial perforator position is known within relatively small limits. If such precise predetermination of the starting point is not required, a wheel tooth configuration of the type illustrated in FIG. 6 may be employed. The toothed wheel of FIG. 6 is mounted to the identical perforator components of the previous embodiment, simply replacing the originally described cutter wheel.

Figure 6:
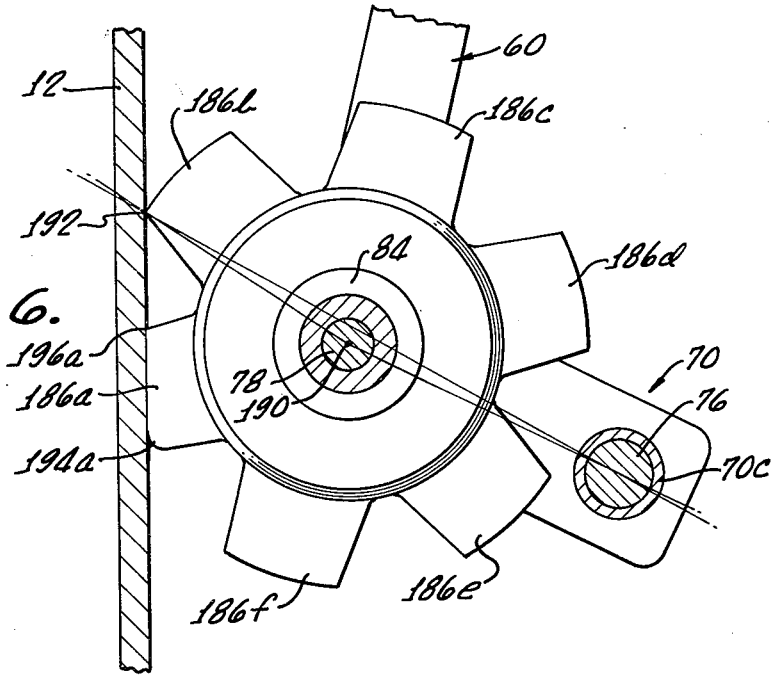
FIG. 6 illustrates a modified cutter wheel.

In the arrangement of FIG. 6, the wheel also has six teeth of which five are mutually identical. Thus, the wheel of FIG. 6 has teeth 186*a*, 186*b*, 186*c*, 186*d*, 186*e*, 186*f*. Five of these teeth, 186*b* through 18*f*, are identical to each other and have truncated outer ends for desirable penetration as described above. The truncated ends may be straight as in the earlier described embodiment, or slightly curved as shown in FIG. 6. The sixth tooth, 186*a* which may be termed a starter tooth, is truncated so as to be shorter than the other teeth. Further, the outer end of tooth 186*a*, like the outer ends of each tooth of the wheel of the previously described embodiment, extends along a line that intersects an adjacent tooth. More specifically, as can be seen in FIG. 6, the flat and straight outer end of tooth 186*a* lies on a line that intersects the point of contact between the adjacent tooth 186*b* and the casing wall 12, when this wheel is in start position. The outer end of the starter tooth 186*a* is cut at a small angle to a tangent, at the radius bisecting tooth 186*a*, to a circle circumscribing the other teeth. As before, this provides the starter tooth 186*a* with a relatively short heel 196*a* and a relatively longer toe 194*a*. This angle may be less than 16 degrees if the starter tooth toe is also shorter than the other teeth. Nevertheless, the radial extent of the starter tooth and the angle of its end must permit the wheel axis to reach the over-center start position. As in the previous embodiment, it is the smaller radial extent of the starter tooth (or its heel) that enables the wheel axis 190 to reach an over-center position that is slightly offset on the lower side of the dead-center line that extends between the pivot axis of arm 70 and the point 192 at which the adjacent tooth 186*b* contacts the casing wall.

With a wheel of the type shown in FIG. 6, the wheel will be in a start position only when tooth 186*a* has its end lying substantially flush with the casing wall. Therefore, in moving the pivot arm and wheel of FIG. 6 from retracted position to a start position, any tooth other than tooth 186*a* or 186*b* may first contact the casing wall, depending upon the initial rotational position of the wheel. For example, as the piston is driven down and the arm swings downwardly from its retracted position, the first contact may be such as to cause teeth 186*c* and 186*d* to both contact the casing wall 12. In such case, the wheel pivot axis 190 will not attain its over-center position, and therefore, when the entire perforator is raised by raising the drill string, the wheel simply rotates about the wheel axis without perforating the pipe and will continue to do so as the perforator is raised until the wheel rotates to the position illustrated in FIG. 6. Here the wheel axis does go over center because of the relatively short radial extent of the starter tooth heel 196*a*. When the wheel of FIG. 6 attains the position illustrated in this FIG. 6, further raising of the perforator will cause a cutting action, the pivot arm further rotating counterclockwise until it hits the stop blocks and the wheel rotating, cutting and perforating in the same manner as described in connection with the earlier embodiment. With the arrangement of FIG. 6, therefore, the point at which cutting begins may be anywhere within a line generally equal in length to about the diameter of the toothed wheel, whereas, with the embodiment of FIGS. 1–5, the point of initiating cutting is more precisely related to the perforator position.

The arrangements described above employ an actuator to swing the pivot arm and wheel downwardly and then moves the entire perforator upwardly. A large upward pulling force, in the order of many thousands of pounds, is readily exerted by pulling on the drill string. However, it will be appreciated that the entire arrangement could be reversed, in effect turning the entire perforator up-side-down so that the actuator would swing the pivot arm upwardly and thereafter the drill string would push the entire perforator downwardly.

It will be observed that a significant advantage of the described arrangement derives from the fact that a relatively small force is all that is required to be applied by the actuator since the much larger perforating force exerted by pulling the device upwardly during the cutting operation is not applied against the initial positioning force of the actuator. This is so by reason of the over-center position which causes the upward pulling force to react against the casing through the cutting teeth on one side, and through the rollers 32, 34 on the other side. This is an over-center toggle linkage arrangement wherein the pivot arm is one of the pair of toggle links and the cutter wheel is the other. Location of the pivot axis of the arm 70 close to the far side of the perforator body, the side that carries rollers 32, 34, enables a greater length of the toggle links, the sum of the distances between (a) the pivot axis of the arm and the wheel axis and (b) the wheel axis and the point of toe contact, being nearly equal to the diameter of the casing. This enables a greater mechanical advantage to be derived from the over-center geometry. The described arrangement does not rely on the relatively smaller force of the actuator to maintain the cutter wheel in its cutting position or to accomplish the initial penetration by the cutter wheel. Instead, it increases the relatively larger pulling force of the drill string and employs this increased force to press the cutter teeth against the casing.

There have been described various arrangements for perforating a casing within the ground employing a greatly simplified and more effective arrangement in which a cutter wheel acts as one link of a pair of toggle links that are moved to an over-center position to ensure properly directed forces of increased magnitude to initiate cutting action.

The foregoing detailed description is to be clearly understood as given by way of illustration and example only, the spirit and scope of this invention being limited solely by the appended claims.

What is claimed is:

1. A casing perforator for perforating casing within the ground comprising a perforator body, a pivot arm mounted to the body to swing in upward and downward directions about a pivot axis, a toothed cutter wheel mounted to the pivot arm for rotation about a wheel axis, an actuator on the body for moving said arm about said pivot axis to a start position in which a pair of teeth of the wheel engages the interior surface of the casing and in which said wheel axis is offset in one of said directions from a line between said pivot axis and the point of contact of one of said teeth and casing, said arm being movable to a retracted position in which said wheel axis is offset in the other of said directions from said line, and means for moving said perforator body in the other of said directions.

2. The perforator of claim 1 wherein said axes are nearly at the same elevation when said arm is in said start position.

3. The perforator of claim 1 wherein one tooth of said pair has a pair of outwardly directed sides and an outer end extending between said sides along a line that intersects the other tooth of said pair.

4. The perforator of claim 1 including means on said perforator body for limiting motion of said arm in said one direction.

5. The perforator of claim 1 wherein at least one tooth of said wheel has outwardly directed sides and an outer cutting end extending for a distance between said sides.

6. The perforator of claim 1 wherein at least the other tooth of said pair has a truncated outer end extending for a distance at an acute angle to a tangent to the wheel periphery at the center of said other tooth.

7. The perforator of claim 6 wherein a line along said outer end of said other tooth intersects an outer end of said one tooth of said wheel and extends along the interior surface of the casing when said pivot arm is in said start position.

8. The perforator of claim 1 wherein each tooth has a substantially flat outer end cut at an acute angle to a tangent to the wheel periphery at the tooth center to provide each tooth with a relatively short heel and a relatively long toe having a point, the outer end of each tooth lying on a line that intersects the point of the toe of an adjacent tooth.

9. The perforator of claim 8 wherein said wheel has six identical teeth and said angle is not less than about sixteen degrees.

10. The perforator of claim 1 wherein said actuator comprises a fluid cylinder having a piston at one end connected to said arm and having a fluid input at the other end, said piston having a hollow end adjacent said other end of said cylinder, said cylinder having a first fluid outlet port, said hollow piston having a second fluid outlet port adapted to be in fluid communication with said first outlet port, and valve means in said hollow piston for blocking one of said outlet ports, whereby pressurized fluid admitted to said cylinder will either shift said piston or pass through said outlet ports under control of said valve means.

11. The perforator of claim 10 including a first spring interposed between said piston and cylinder for urging said piston toward said other end of said cylinder, said valve means comprising a check valve having a valve member and a second spring for urging the valve member to closed position, said second spring being stiffer than said first spring, whereby fluid under relatively lower pressure introduced into said cylinder will drive said piston toward said one end of said cylinder but will not open said check valve, and fluid under relatively higher pressure will open said check valve to allow a casing in which said perforator is positioned to be exposed to high pressure fluid.

12. A casing perforator comprising an elongated perforator body having a longitudinal axis, a pivot arm journalled to said body about a pivot axis transverse to said longitudinal axis, a toothed wheel journalled to said pivot arm about a wheel axis, means for moving said arm about said pivot axis between first and second positions, said first position being a release position in which said wheel axis is spaced by a first distance from a casing surface line parallel to said perforator body axis and representing the inside of a casing in which said perforator is to be operated, said first distance being greater than the radius of said wheel, said second position being a start position in which a pair of adjacent teeth of said wheel contact said casing surface line and said wheel axis is spaced from said casing surface line by a second distance which is less than said wheel radius, said wheel axis in said second position being offset in one direction from a dead-center line extending between said pivot axis and a point of contact between said casing surface line and one of the teeth of said pair, and means for moving said perforator body in a direction opposite said one direction so as to urge said wheel axis toward said dead-center line and to urge said wheel outwardly toward said casing surface line.

13. The perforator of claim 12 wherein said means for moving said pivot arm comprise an actuator arm pivotally connected to said pivot arm on the same side of said pivot axis as said wheel axis.

14. The perforator of claim 13 wherein said pivot axis is located adjacent one side of said perforator body and said wheel axis is located adjacent the other side of said body in said second position.

15. The perforator of claim 12 in which one of said adjacent teeth has a flat truncated end that lies along said casing surface line in said second position.

16. A casing perforator adapted to be inserted into a casing to make a series of perforations therein, said perforator comprising an elongated perforator body, a pivot arm journalled on said body about a pivot axis, a cutter wheel journalled on said pivot arm for rotation about a wheel axis, said wheel having a plurality of cutting teeth, means for moving said pivot arm and wheel to a cutting position wherein two of said teeth contact the interior of a casing to be perforated, and wherein said wheel axis is close to but slightly spaced in one direction from a dead-center line between said pivot axis and a point of contact of one of said two teeth with the casing, and means for driving said body in a second direction opposite said one direction.

17. The perforator of claim 16 wherein said means for moving said pivot arm and wheel comprise an actuator arm pivotally connected to said wheel and pivot arm adjacent said wheel axis.

18. The perforator of claim 16 including reaction means bearing against the inside of a casing carried at one side of said perforator body, said pivot axis being positioned adjacent said one side, whereby said pivot arm and wheel in cutting position extend from said pivot axis across nearly the entire diameter of said casing.

19. The perforator of claim 16 wherein one of said two teeth has a truncated outer end extending along a line that intersects the other of said two teeth.

20. Apparatus for perforating well casing within the ground, comprising an elongated perforator body having a longitudinal axis, means on one side of said body for bearing against the interior of casing to be perforated, a pivot arm journalled to said body on a pivot axis adjacent said one side, a cutter wheel having a plurality of cutting teeth, said wheel being journalled on said pivot arm for rotation about a wheel axis, an actuator mounted to said body, actuator link means connected to and between said actuator and said pivot arm for driving said arm between a first position in which the arm is upwardly inclined at a large angle with respect to a perpendicular to the axes of the casing and perforator body, with the wheel teeth spaced inwardly of the casing, and a second position in which the arm is nearly perpendicular to the axes of the casing and perforator body, but is upwardly inclined at a relatively small angle with respect to said perpendicular, with at least one tooth of said wheel in contact with the casing at a point above the wheel axis, means for energizing said actuator to move said arm downwardly to said second position, and means for pulling said actuator body upwardly through said casing.

21. The perforator of claim 20 including a stop block on said body below said pivot arm and positioned to limit motion of said arm to a third position displaced from said first position by a greater amount than said second position.

22. The perforator of claim 20 wherein a tooth of said wheel positioned adjacent and downwardly of said one tooth in said second position has a truncated outer end extending along a line that intersects the point of contact of said one tooth and the casing.

23. The perforator of claim 20 wherein said wheel axis is offset downwardly of a line between said pivot axis and the point of contact of said one tooth when said arm is in said second position.

24. The perforator of claim 20 wherein a tooth adjacent said one tooth has a truncated outer end that contacts the casing when said arm is in said second position.

* * * * *